US012806509B2

(12) United States Patent
Yarro

(10) Patent No.: US 12,806,509 B2
(45) Date of Patent: Nov. 24, 2026

(54) GAMING TABLE

(71) Applicant: Yarro Studios, Inc., Orem, UT (US)

(72) Inventor: Tanner Yarro, Provo, UT (US)

(73) Assignee: Yarro Studios, Inc., Orem, UT (US)

( * ) Notice: Subject to any disclaimer, the term of this patent is extended or adjusted under 35 U.S.C. 154(b) by 217 days.

(21) Appl. No.: 18/784,175

(22) Filed: Jul. 25, 2024

(65) Prior Publication Data

US 2025/0032895 A1 Jan. 30, 2025

Related U.S. Application Data

(60) Provisional application No. 63/528,716, filed on Jul. 25, 2023.

(51) Int. Cl.
*A63F 3/00* (2006.01)

(52) U.S. Cl.
CPC *A63F 3/00895* (2013.01); *A63F 2003/00981* (2013.01)

(58) Field of Classification Search
CPC ..... A63F 3/00895; A63F 2003/00981; A63F 2003/00987; A47B 3/083
See application file for complete search history.

(56) References Cited

U.S. PATENT DOCUMENTS 2,707,141 A * 4/1955 Witter ..... A47B 13/16 108/26
7,575,240 B1 * 8/2009 Voden ..... A47B 25/00 273/309
2007/0029731 A1 * 2/2007 Barker ..... A63F 1/06 273/309

OTHER PUBLICATIONS

"Our Innovative Dining/Game Room Table—The Councilor", by Rathskellers. Apr. 22, 2022. pp. 1-12. (https://web.archive.org/web/20220422184143/https://www.rathskellers.com/the-councilor-game-room-dining-table-for-board-games/) (Year: 2022).*
"DIY Board Game Table Top", by HappyDrabb in Workshop. May 23, 2022. pp. 1-30 (via Wayback Machine to show prior art date evidence, includes image-based disclosure on pp. 11-30) (https://web.archive.org/web/20220523144025/https://www.instructables.com/DIY-Board-Game-Table-Top/) (Year: 2022).*
Yarro Studios TikTok. Nov. 9, 2022. pp. 1-3 (https://www.tiktok.com/@yarrostudiosrpg/video/7164103919357119790) (Year: 2022).*
"The Rail and Accessories System for My Gaming Table—and Making Two Dice Trays for it.", by DiceyRolls. Mar. 28, 2021. pp. 1-2. (https://www.youtube.com/watch?v=0slQgB-w3Dw) (Year: 2021).*
(Continued)

*Primary Examiner* — Will A Brandenburg
(74) *Attorney, Agent, or Firm* — DENTONS Durham Jones Pinegar

(57) ABSTRACT

This disclosure relates generally to a foldable, transportable, table with a rail about a perimeter of the foldable table. The rail may be irreversibly or reversibly affixed to the table. The rail may define a cavity, or channel or groove that extends the length of the rail and configured to accept a tray of some sort. The tray may be utilized as another "table" to allow for dice rolling, card holding, or other game playing purposes. The tray may freely slide along the rail, around the table to allow for the tray to be moved from one position to another and to any of an infinite number of positions. The rail may create a trough or walled portion of the table so that elements of a game cannot freely slide off the edge of the table and are stopped by the "wall" of the rail.

21 Claims, 8 Drawing Sheets

(56) References Cited

OTHER PUBLICATIONS

"The Wyrmwood Modular Gaming Table—Should You Back It?", by BoardGameCo. Aug. 18, 2020. pp. 1-2. (https://www.youtube.com/watch?v=HPLCJ7M5CSI) (Year: 2020).*

"The Wyrmwood Modular Gaming Table Is The Best Gamer Gift You Can't Buy", by Anthony Karcz. Dec. 19, 2021. pp. 1-15. (https://www.forbes.com/sites/anthonykarcz/2021/12/19/the-wyrmwood-modular-gaming-table-is-the-best-gamer-gift-you-cant-buy/) (Year: 2021).*

* cited by examiner

GAMING TABLE

CROSS REFERENCE TO RELATED APPLICATION

A claim for priority to the Jul. 25, 2023 filing date of U.S. Provisional Patent Application No. 63/528,716, titled GAMING TABLE is hereby made pursuant to 35 U.S.C. § 119(e). The entire disclosure of this Provisional Application is incorporated herein by reference.

TECHNICAL FIELD

This disclosure relates generally to gaming equipment and, more specifically, to foldable tables for playing games. The features disclosed herein may be numerous in nature and may be employed in various different ways to provide the same or similar results. The following description may refer to a gaming table, a table, a folding table, a foldable gaming table or other apparatus all of which refer to the same element or mechanics in its use.

SUMMARY

Disclosed are systems, devices, and/or methods of use thereof regarding gaming equipment and, more specifically, foldable tables for playing games. In various aspects, a foldable gaming table may include a tabletop comprising a first half and a second half, with each of the first half and the second half having a top surface, a bottom surface opposite the top surface, and a sidewall extending therebetween. The first half may be hingedly connected to the second half. The foldable gaming table may also include a pair of legs, where a first leg of the pair is connectable to the bottom surface of the first half and a second leg of the pair is connectable to the bottom surface of the second half of the tabletop. The foldable gaming table may further include a rail having a first half and a second half, with the first half of the rail disposed on the top surface of the first half of the tabletop and the second half of the rail disposed on the top surface of the second half of the tabletop.

In some embodiments, the first half of the rail matches a shape or outline of the first half of the tabletop and the second half of the rail matches a shape or outline of the second half of the tabletop. Additionally, ends of the first half and the second half of the rail may flushly abut each other when the foldable gaming table is in an upright configuration. In other words, ends of the first half and the second half of the rail may be even with each other when the table is in the upright configuration.

In other aspects, a foldable gaming table may include a tabletop having a first half hingedly connected to a second half. The tabletop may have a top surface, a bottom surface, and a sidewall extending therebetween. The foldable gaming table may also include a pair of legs connectable to the bottom surface of the tabletop, and a rail having a first portion hingedly connected to a second portion. The first portion of the rail may be disposed about a perimeter of the first half of the tabletop and the second portion may be disposed about a perimeter of the second half of the tabletop. The foldable gaming table may further include a tray receivable within a groove defined by the first portion and the second portion of the rail. The tray may be slidable within the groove to various positions about the rail and the tabletop.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Figure 1:
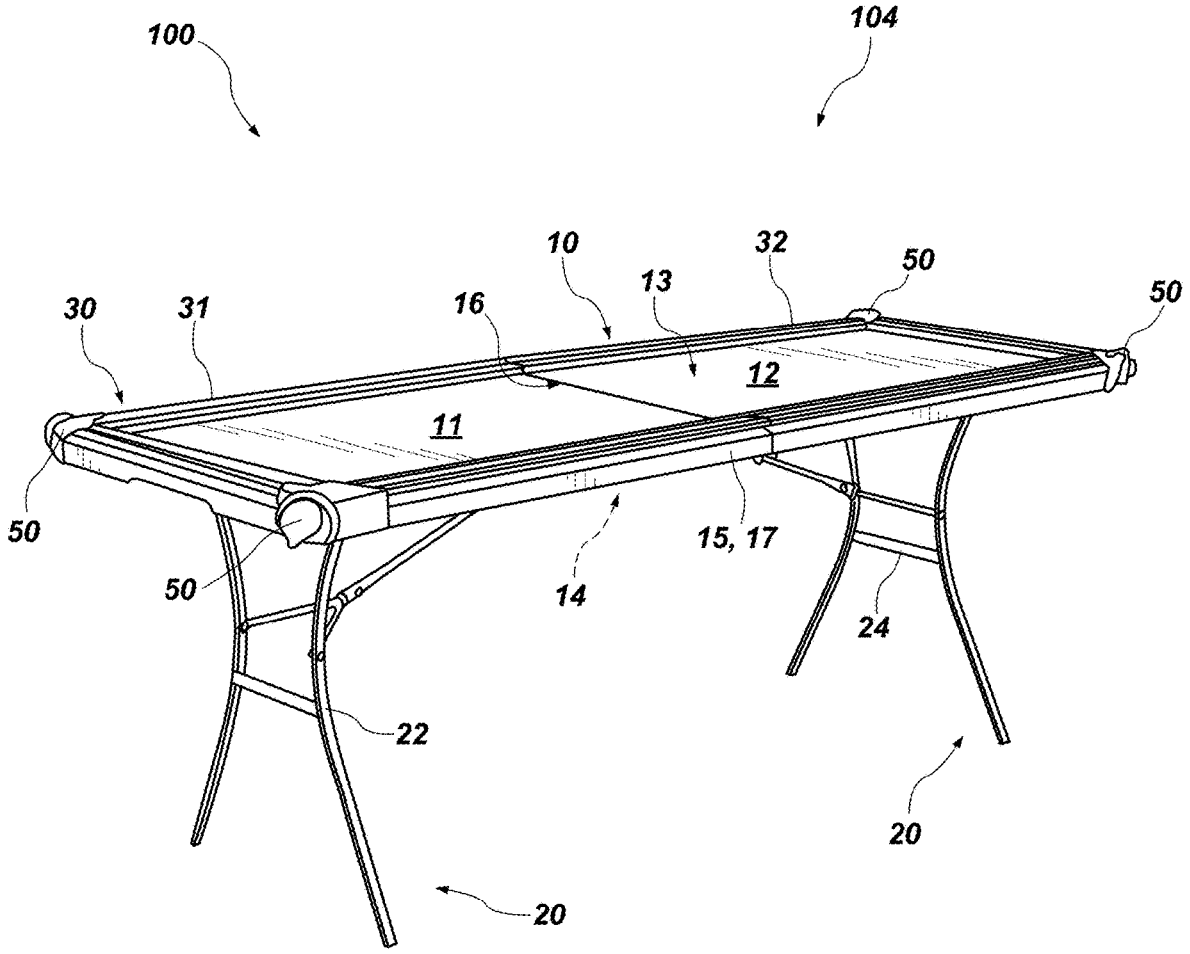
FIG. 1 illustrates a front, perspective view of a foldable gaming table according to the present disclosure.

Many types of games (e.g., board games, card games, role-playing games, etc.) require a surface upon which to play. For example, board games require a surface upon which to place the gaming board, move gaming pieces, and roll dice. Role-playing games can require a surface upon which to roll dice, move gaming pieces or characters, play cards, etc. Conventional tables usually provide a good surface for game play. However, conventional tables are generally heavy and not portable. Additionally, conventional tables have open or flat perimeters that match the same planar surface as the table itself, meaning it can be easy to lose various gaming pieces off the edges of the table, which can frustrate game play. Further, conventional tables do not provide any storage for game pieces.

Embodiments of the present disclosure address these and other problems with game play. In various aspects, a foldable gaming table may include a tabletop comprising a first half and a second half, with each of the first half and the second half having a top surface, a bottom surface opposite the top surface, and a sidewall extending therebetween. The first half may be hingedly connected to the second half. The foldable gaming table may also include a pair of legs, where a first leg of the pair is connectable to the bottom surface of the first half and a second leg of the pair is connectable to the bottom surface of the second half of the tabletop. The foldable gaming table may further include a rail having a first half and a second half, with the first half of the rail disposed on the top surface of the first half of the tabletop and the second half of the rail disposed on the top surface of the second half of the tabletop. The rail may extend around a periphery of the table.

In some embodiments, the first half of the rail matches a shape or outline of the first half of the tabletop and the second half of the rail matches a shape or outline of the second half of the tabletop. Additionally, ends of the first half and the second half of the rail may flushly abut each other when the foldable gaming table is in an upright configuration. In other words, ends of the first half and the second half of the rail may be even with each other when the table is in the upright configuration.

In other aspects, a foldable gaming table may include a tabletop having a first half hingedly connected to a second half. The tabletop may have a top surface, a bottom surface, and a sidewall extending therebetween. The foldable gaming table may also include a pair of legs connectable to the bottom surface of the tabletop, and a rail having a first portion hingedly connected to a second portion. Or rather, the rail may simple be attached to the table and the two halves of the table are hingedly connected that allows the rail to sit flush when the table is "unfolded" and in an upright position and the rails may not be hinged at all. The first portion of the rail may be disposed about a perimeter of the first half of the tabletop and the second portion may be disposed about a perimeter of the second half of the tabletop. The foldable gaming table may further include a tray receivable within a groove defined by the first portion and the second portion of the rail. The tray may be slidable within the groove to various positions about the rail and the tabletop.

FIG. 1 illustrates a front, perspective view of a foldable gaming table 100 according to the present disclosure. As illustrated, the foldable gaming table 100 is in an upright configuration 104 and includes a tabletop 10, a pair of legs 20 connectable to the tabletop 10, and a rail 30 disposed about the tabletop 10. Optionally, end caps such as decorative end caps 50 may be positioned about corners of the tabletop 10. The tabletop 10 may include a first half 11 connected to a second half 12. The first half 11 may be hingedly or pivotally connected to the second half 12, or connected in another fashion that allows the tabletop 10 to hinge or fold. The first half 11 may be connected to the second half 12 by a hinge or at a pivot point 16. The tabletop 10 (e.g., the first half 10 and the second half 12) has a top surface 13, a bottom surface 14 opposite the top surface 13, and a sidewall 15 extending therebetween.

In some embodiments, the sidewall 15 approximates a perimeter or outline 17 of the tabletop 10. The sidewall 15 and/or the perimeter 17 may define a shape of the tabletop 10. As illustrated, the tabletop 10 is substantially rectangular, though other shapes (e.g., circular, trapezoidal, etc.) are contemplated herein. A height of the sidewall 15 may impart a thickness to the tabletop 10.

The rail 30 may be disposed around a periphery or perimeter 17 on the top surface 13 of the tabletop 10. In some embodiments, the rail 30 includes a first portion 31 disposed on the top surface 13 of the first half 11 of the tabletop 10. The rail 30 may also include a second portion 32 disposed on the top surface 13 of the second half 12 of the tabletop 10. A shape of the rail 30 may match or correspond to the perimeter 17 of the tabletop 10. For example, as illustrated, the rail 30 is substantially rectangular to match the substantially rectangular perimeter 17 of the tabletop 10. In some embodiments, the first and second portions 31, 32 of the rail 30 are substantially U-shaped; together, the U-shaped first and second portions 31, 32 create the substantially rectangular shape of the rail 30.

When the table 100 is in the upright configuration 104, as illustrated in FIG. 1, the first half 11 of the tabletop 10 is substantially flush or even with the second half 12. That is, the first and second halves 11, 12 create a planar top surface 13 for playing games (e.g., rolling dice, setting up a game board, moving game pieces, etc.). Similarly, when in the upright configuration 104, the first portion 31 of the rail 30 is substantially flush or even with the second portion 32. That is, ends of the first portion 31 and the second portion 32 are flush with where they meet each other, such as at the hinge 16. The flush meeting of the first and second portion 31, 32 gives the rail 30 a continuous configuration when the table 100 is in the upright configuration 104.

The continuous configuration of the rail 30 allows various accessories to be attached to the rail 30 and slid around the rail 30 and, thus, around the table 100. The continuous configuration of the rail 30 also minimizes the risk of items catching (e.g., clothing, dice bags, etc.) on seams or discontinuities within the rail 30, as well as minimizing the risk of items being scratched (e.g., user's skin or hands, game boards, etc.) by discontinuities within the rail 30.

Additionally, the rail 30 (or sidewalls 35 of the rail 30) may be substantially flush or continuous with the sidewall 15 of the tabletop 10. In this way, the rail 30 may provide a bumper or ridge surrounding the perimeter 17 of the tabletop 10. This may prevent elements of game play (e.g., characters, dice, etc.) from falling off edges of the tabletop 10 and may provide a platform for users to rest their arms on. Alternatively, the rail 30 may be positioned about the sidewall 15 of the tabletop 10 such that the rail 30 may be flush with the top surface 13 of the tabletop 10.

Figure 2A:
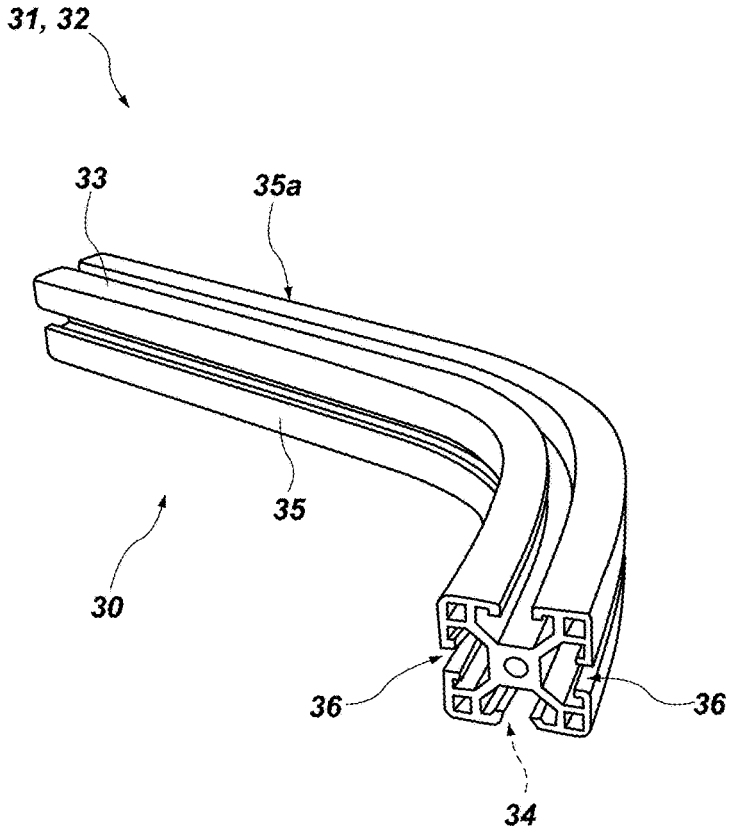
FIG. 2A illustrates a close-up view of a portion of a rail to be disposed on the foldable gaming table of FIG. 1.
Figure 2B:
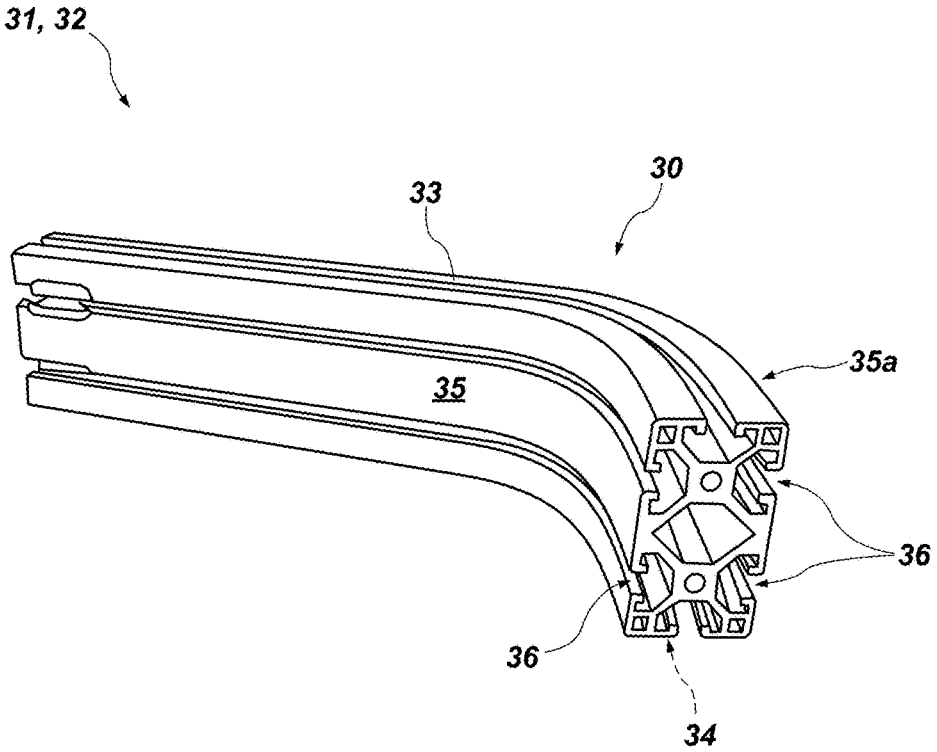
FIG. 2B illustrates an alternate portion of a rail to be disposed on the gaming table of FIG. 1.

FIGS. 2A-2B illustrate close-up views of a portion of a rail 30 to be disposed on the foldable gaming table 100 of FIG. 1. Specifically, FIGS. 2A-2B illustrate embodiments of the first portion 31 and/or the second portion 32. The rail 30 (e.g., the first portion 31 and the second portion 32) includes a top surface 33, a bottom surface 34 opposite the top surface 33 (not illustrated), and an internal sidewall 35, or innerwall, extending between the top and bottom surfaces 33, 34 and an external sidewall **35*a*, or outerwall. Defined within the sidewalls 35, 35*a* may be one or more groove(s) 36, or channels. In some embodiments, the grooves 36, or channels are disposed symmetrically about the sidewalls 35, 35*a*. Additionally, the top and/or bottom surfaces 33, 34 may define grooves 36**, or channels.

As illustrated in FIG. 2A, the first or second portions 31, 32 of the rail 30 may include a groove 36, or channel in each of the top surface 33, the bottom surface 34, and symmetrically within the sidewalls 35, **35*a*. As illustrated in FIG. 2B, the first or second portion 31, 32 may have a "double-decker" or "stacked" configuration, which approximates two rails 30 of FIG. 2A stacked on each other. The rails 30, may be substantially rectangular or square in cross-sectional shape. The rails 30 may include single channels 36 on the top surface 33, or the sidewalls 35 so as to create a smooth portion of the rail 30 on any of one (1) to three (3) of the sides of the rail 30. An inner sidewall 35 may be defined as the sidewall facing the tabletop 10 and an outer sidewall 35' may be defined as the sidewall facing away from the tabletop 10. Additionally, channels 36 may only reside on the top surface 33 and outside sidewall 35 so as not to create an obstacle on the inner sidewall 35; however, channels 36 on each side is contemplated as is any different cross-sectional polygonal shapes of rails 30**.

The rail 30 (i.e., the first portion 31 and/or the second portion 32) may be permanently adhered or attached to the tabletop 10 and/or about the perimeter 17 of the tabletop 10. Specifically, the bottom surface 34 of the rail 30 may be disposed on the top surface 13 of the tabletop 10. For example, the rail 30 (i.e., the first portion 31 and/or the second portion 32) may be hingedly attached to the tabletop 10. In some embodiments, the groove 36, or channels, defined in the bottom surface 34 of the rail 30 may hingedly connect the rail 30 to the tabletop 10. The rail 30 may be attached to the tabletop 10 in such a way that the rail 30 can be pivoted or hinged off the top surface 13 and folded under the bottom surface 14 of the tabletop 10. Such a connection or attachment allows the table 100 to be hinged and folded into a fully folded configuration 103 (see FIG. 5C), where the legs 20 and the rail 30 are stored within the folded table 103.

The bottom surface 34 of the rail 30 may be smooth, or planar, without a channel 36 and simply provide a means for adhering the bottom surface 34, and thus the entire rail 30, to the table 100.

Additionally, and/or alternatively, the rail 30 may be removably attached to the top surface 13 of the tabletop 10. In such embodiments, the rail 30 may be removed from the tabletop 10 prior to folding the table 100 into the fully folded configuration 103, or the rail 30 may be removed after fully folded and kept as a separate piece to the table 100 (and even consideration is made to have it fixed to the table 100 in an easy carry mode). The rail 30 may be attached to the tabletop 10 via adhesives, fasteners, clips, snaps, adhesive, screws, barbed screws or projections mating with apertures on the tabletop 10, barbed screws or projections mating with apertures on the rail 30, etc.

In some embodiments, the rail 30 is an aluminum extruded rail 30. In some embodiments, the rail 30 may be constructed from extruded carbon, carbon fiber, aluminum alloys, thermoplastic, acrylic, and/or combinations thereof. In all embodiments, the rail 30 is configured to match or correspond to a perimeter 17 of the tabletop 10, such that the rail 30 may be positioned about (e.g., turn) corners of the tabletop 10. In other words, the rail 30 may "curve" around the corners of the table 100 to allow a continuous rail 30 around the entire table 100.

In the alternate, single linear rails 30 may be utilized to cover each perimeter 17 of the tabletop 10 with an "end piece" that may be decorative or may be a single curved rail piece that is attached to match, and sit flush with, the linear pieces. In the "end piece" configuration that does not include a "bend" or "curve," the rail 30 may not allow for a contiguous channel 36 around a corner or curve of the table 100. Additionally, the rail 30 may reside on each of the first half 11 and second half 12, or alternatively the rail 30 may run the length of the tabletop 10 and be attached once the table 100 is in the open configuration 104.

Figure 3:
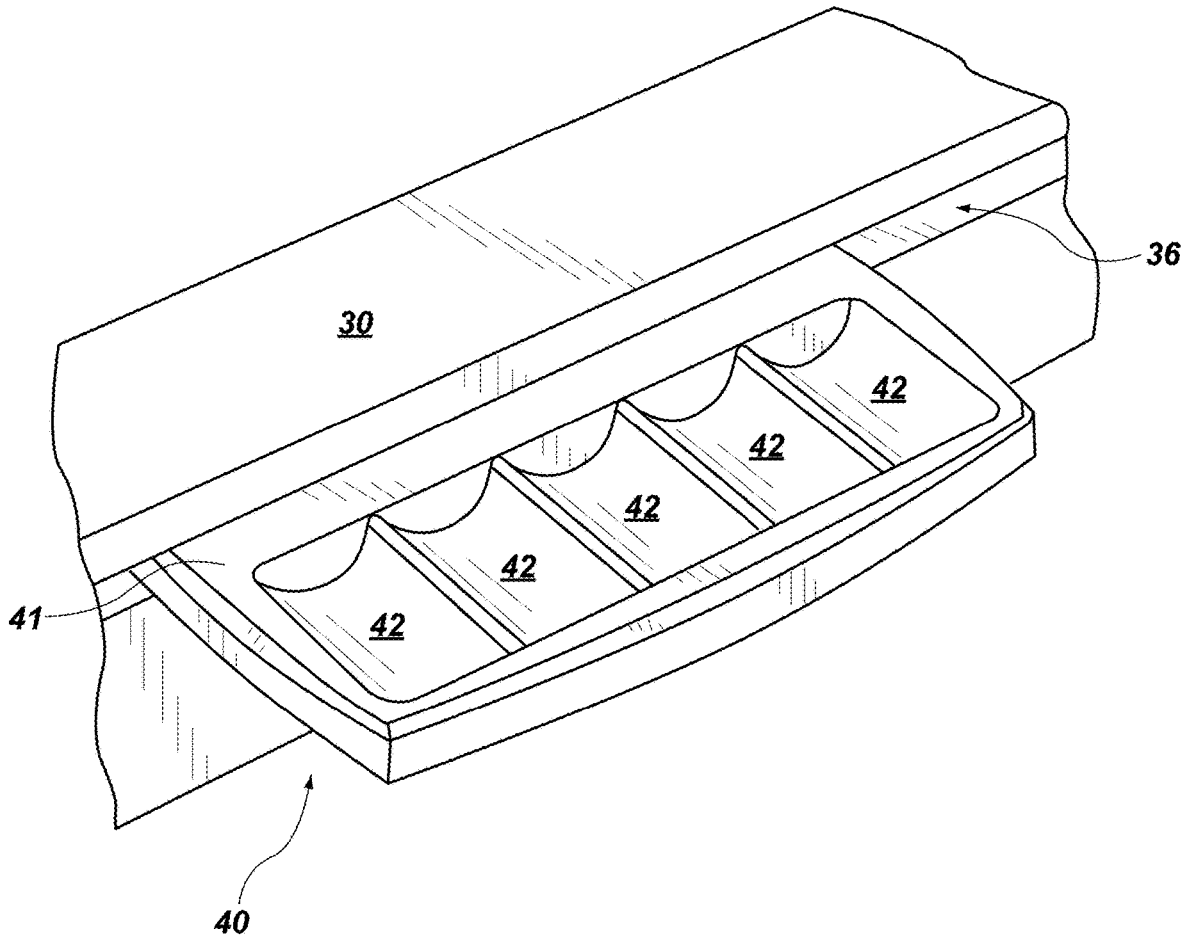
FIG. 3 illustrates an embodiment of a tray to be positioned within the rail of FIG. 2 for the foldable gaming table of FIG. 1.

FIG. 3 illustrates an embodiment of a tray 40 to be positioned (e.g., removably or permanently positioned) within the rail 30 of FIG. 2 for the foldable gaming table 100 of FIG. 1. Specifically, the tray 40 may be positioned within a groove 36 of the rail 30. The tray 40 may include a body 41 and a single trough, or cup 42, or a plurality of cavities or cups 42. In some embodiments, the plurality of cups 42 are defined by a separate piece which is placed within the body 41 of the tray 40. In some embodiments, the body 41 defines the plurality of cups 42. In a single trough configuration, it may allow for ease in rolling a plurality of dice, for example.

A portion of the body 41 may be positioned within the groove 36 to attach the tray 40 to the rail 30. For example, the body 41 may include a tab or projection (not illustrated) that is sized and shaped to mate with the groove 36 of the rail 30. Additionally, and/or alternatively, the tray 40 may include bearings or wheels to facilitate sliding of the tray 40 within the groove 36. In some embodiments, the groove 36 may include a receiver (a snap, clip, fastener, etc.) which receives a portion of the tray 40 to thereby attach the tray 40 to the rail 30.

Regardless of how the tray 40 is attached to the rail 30, the tray 40 may be slidable within the groove 36. In this way, the tray 40 can be moved to various positions about the rail 30 and the table 100. For example, the tray 40 may be positioned in front of a first player, who may take their turn such as by rolling dice within the trough or one of the cups 42. After the first player has taken their turn, the tray 40 may be slid along the rail 30 to a position in front of a second player, who may then take their turn. The trough, or the plurality of cups 42, may be for holding items specific to a game such as cards, figures, pencils, paper, or rolling dice or facilitating other game play for various players.

Additionally, the tray 40 may attach to the rail 30 such that the tray 40 is hidden from view when the table 100 is in a fully folded configuration 103 (see FIG. 5C). In some embodiments, the tray 40 is removably attached to the rail 30 and is removed prior to folding up the table 100. In some embodiments, the tray 40 is received by a portion of the tabletop 10 (e.g., received within a cavity of the bottom surface 14, received within an open end cap 50, etc.) when the table 100 is fully folded 103.

Figure 7:
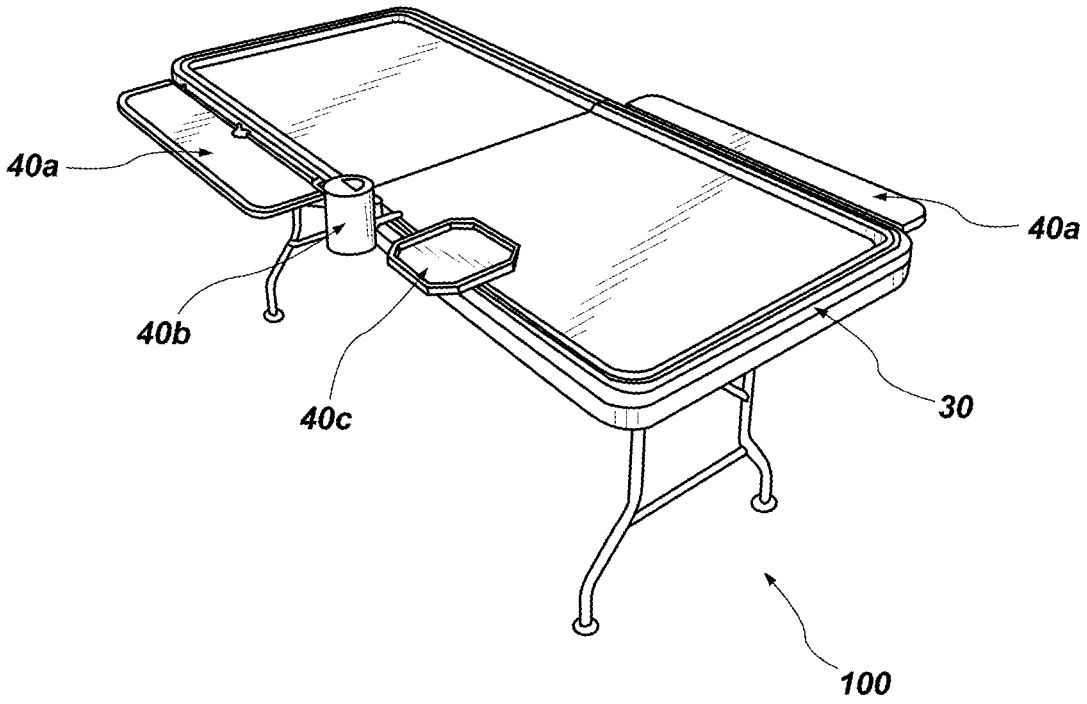
FIG. 7 illustrates a perspective view of the foldable gaming table of FIG. 1 with add-on, or additional, trays.

Referring to FIG. 7, the trays 40 also may include "extenders" 40*a* that may extend the length of the table, or tabletop. Other "trays" 40 may include cupholders 40*b*, dice-rollers 40*c* and the like. Tabletop extenders 40*a* may be flat and planar and may extend away from the tabletop 10 anywhere from two inches (2") to two feet (2'). The extenders 40*a* may include a lip around a perimeter of the extenders or may be completely planar. Dice roller trays 40*c* may reside or engage a groove on the top surface 33 of the rail 30 or a groove on the outerwall 35*a* of the rail 30. The dice roller trays 40*c* may include a peripheral lip maintaining the dice within the dice roller tray. A cup holder tray 40*b* may include a void or large trough to hold a glass or cup and may engage any of the grooves 36 to keep the cup outside the game play area, or first half 11 and second half 12 of the tabletop 10.

The tray 40 may be constructed of any appropriate material For example, the tray 40 may be constructed from wood, carbon fiber, plastic, acrylic, thermoplastics, and/or combinations thereof. The trough or plurality of cups 42 may be of a first material (e.g., plastic, etc.) and the body 41 may be of a second material (e.g., wood).

Figure 4:
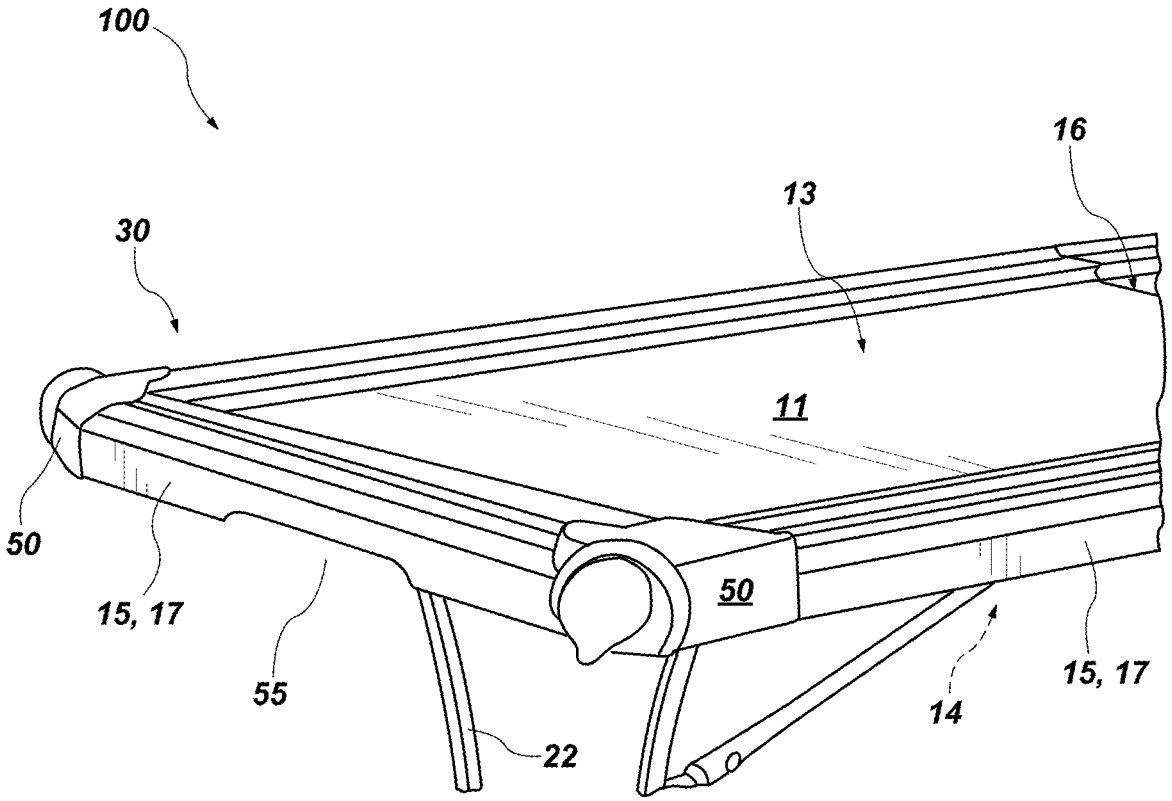
FIG. 4 illustrates a close-up view of decorative end caps placed on two corners of the foldable gaming table of FIG. 1.

FIG. 4 illustrates a close-up view of decorative end caps 50 placed on two corners of the foldable gaming table 100 of FIG. 1. As illustrated, the end caps 50 include a skull decoration or configuration; however, any type of decorative element is contemplated herein. For example, the end caps 50 may include characters, such as Mario, Link, etc.; flora and/or fauna; geometric shapes; and/or other decorative elements. The end caps 50 may be positioned over corners of the tabletop 10 such that the caps 50 receive portions of the rail 30 (as illustrated). The end caps 50 may be positioned over corners of the tabletop 10 and the rail 30 may disposed over the end caps 50. The end caps 50 may prevent contiguous rail 30 formation around the entire table 100 or be positioned in such a way as to allow one contiguous rail 30.

Figure 5A:
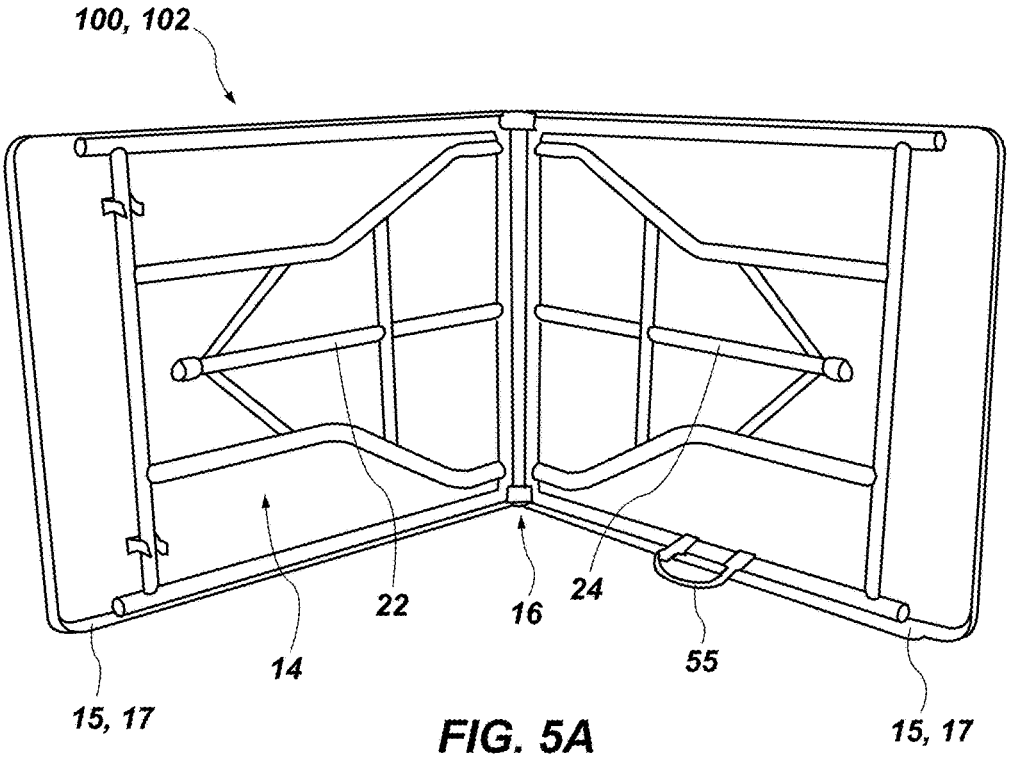
FIG. 5A illustrates a foldable gaming table which may resemble the foldable gaming table of FIG. 1 in a partially folded configuration.
Figure 5B:
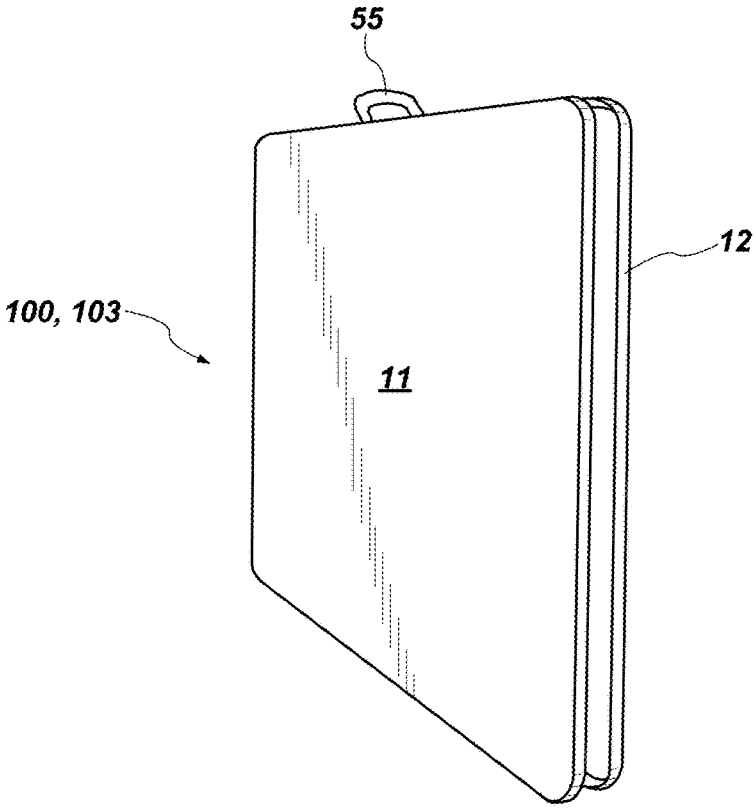
FIG. 5B illustrates the foldable gaming table of FIG. 5A in a fully folded configuration.

FIG. 5A illustrates the foldable gaming table 100 in a partially folded configuration 102 and FIG. 5B illustrates the foldable gaming table 100 in a fully folded configuration 103.

Figure 6A:
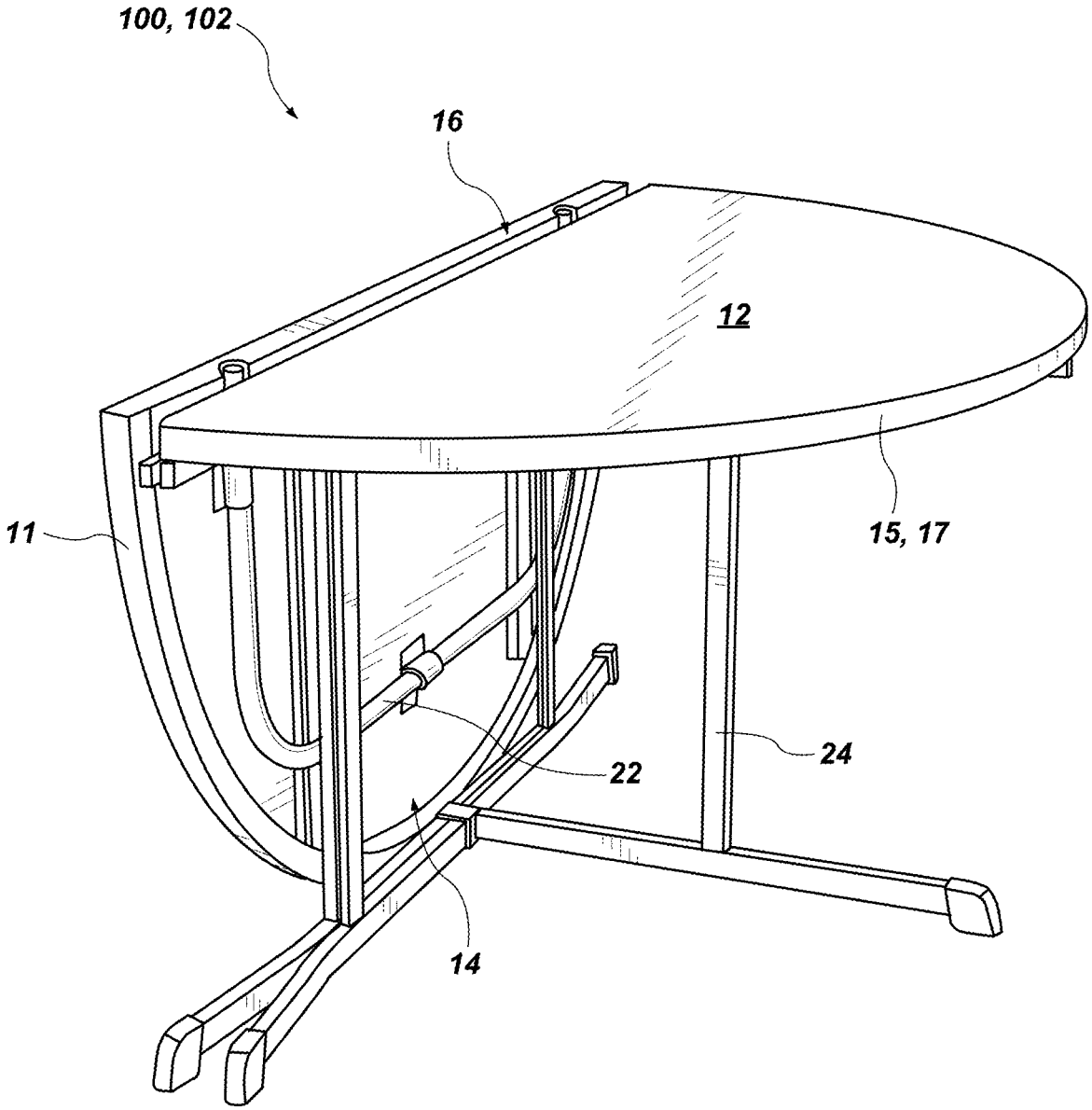
FIG. 6A Illustrates an alternate configuration of a foldable gaming table.
Figure 6B:
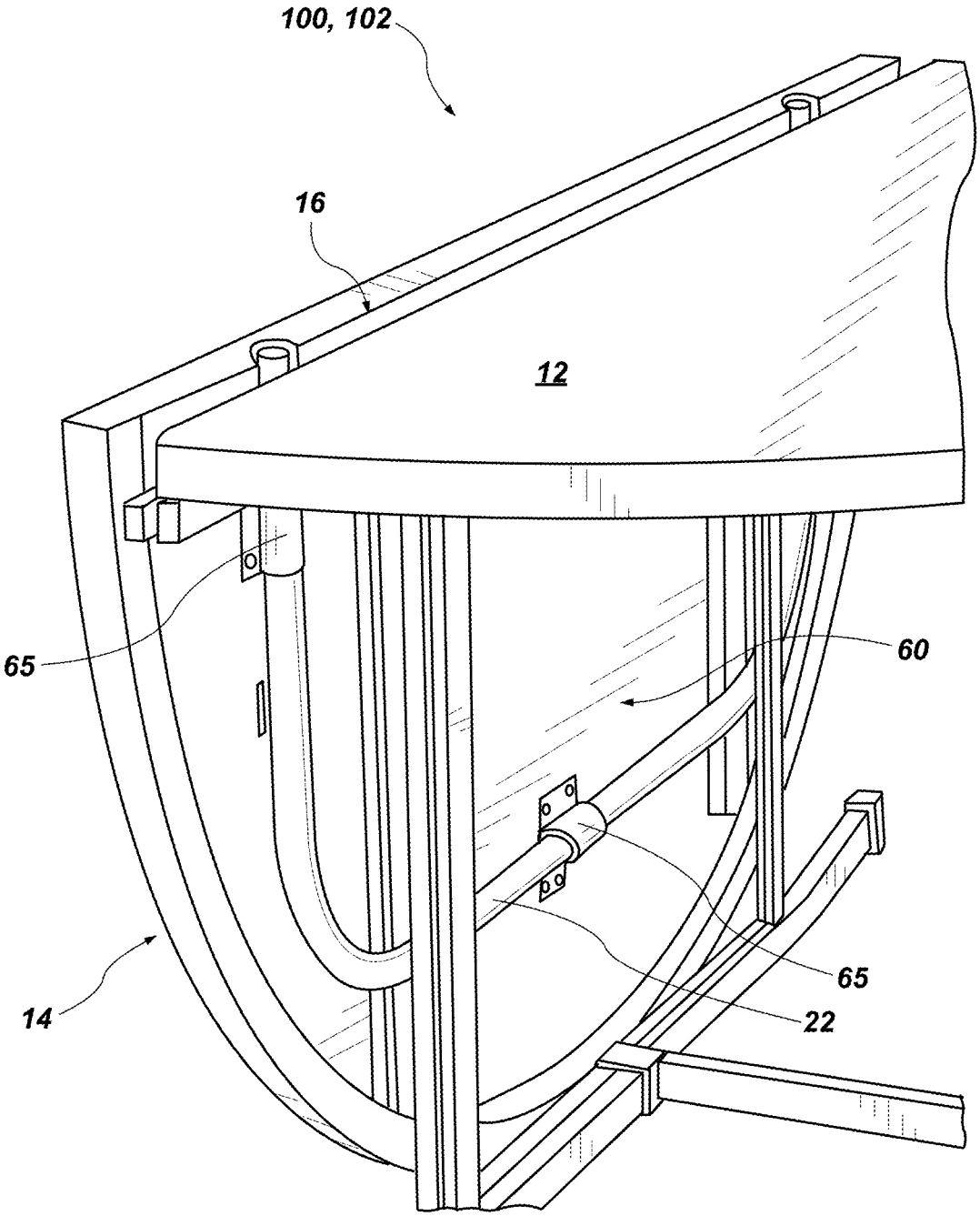
FIG. 6B illustrates a close up view of the foldable gaming table of FIG. 6A.

FIGS. 6A and 6B showcase the table 100 may have a circular shape rather than a rectangular shape (see FIG. 1). As clearly seen in FIG. 5A, the legs 22, 24 of the table 100 fold under the tabletop 10 and towards the bottom surface 14 of the tabletop 10. As seen in FIG. 5B, when the table 100 is in a fully folded, or closed, configuration 103, the legs 22, 24, the rail 30, and the tray 40 may be hidden from view.

Further, as seen in FIGS. 6A and 6B, the bottom surface 14 of the tabletop 10 defines one or more channels or cavities 60 for receiving and storing (i) the legs 22, 24, (ii) the rail 30, and/or (iii) the tray 40. Additionally, the bottom surface 14 may be outfitted with one or more fasteners 65 to secure (i) the legs 22, 24, (ii) the rail 30, and/or (iii) the tray 40 to the bottom surface 14.

Returning to FIG. 5A, the legs 22, 24 are configured to hinge and fold into or under the tabletop 10 (e.g., fold into the bottom surface 14). As shown in FIG. 5B, when fully folded 103, only the top surface 13 of the tabletop 10 is exposed. Specifically, only the top surfaces 13 of the first half 11 and the second half 12 are exposed. In some embodiments, the table 100 includes a handle 55, which may facilitate transportation of the table 100. The handle 55 may be disposed about the sidewall 15 and/or the perimeter 17 of the tabletop 10. Further, the rails 30, may be entirely exposed about each half 11, 12 of the tabletop 10 when in the closed configuration 103.

Figure 8:
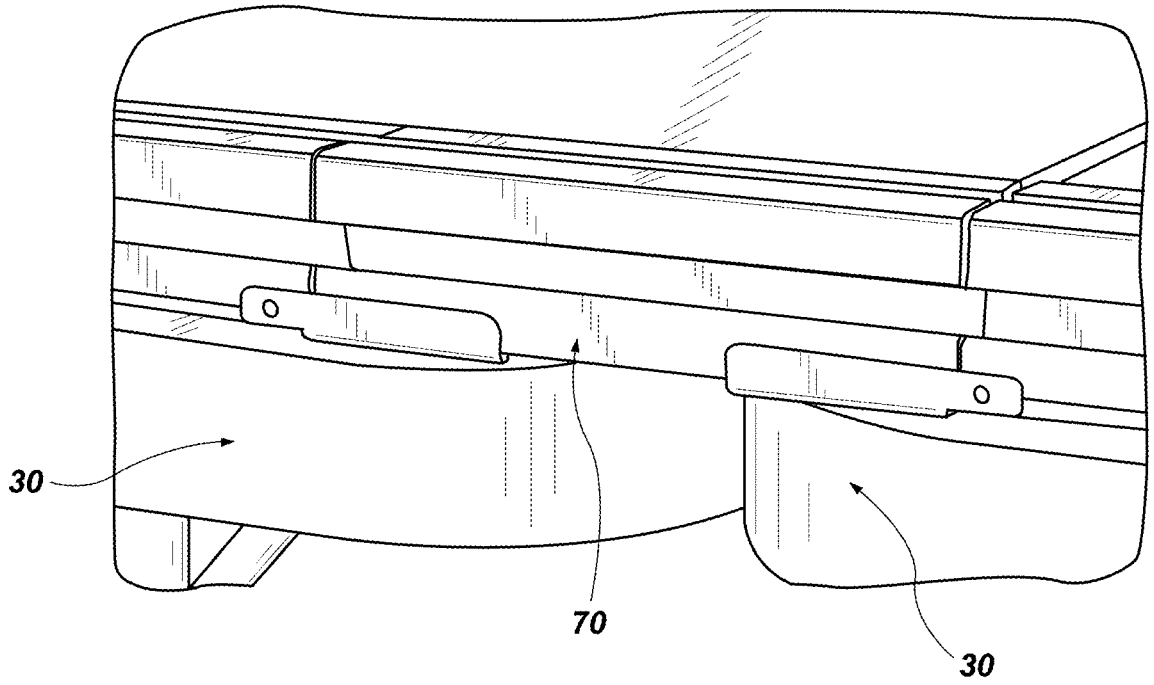
FIG. 8 illustrates a connector of two gaming tables of FIG. 1.

It will be appreciated that the gaming table 100 may also be combined with another gaming table to create a larger playing surface. Referring to FIG. 8 in such instance the rails 30 may be removed from one side of each table, and any curved rail pieces on that same side. The two gaming tables 100 may then be connected together via a connector 70 that may be a small/short piece of rail 30 that may engage each of the gaming tables 100 to create a double size gaming table or surface.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It should also be noted that some of the embodiments disclosed herein may have been disclosed in relation to particular gaming equipment (e.g., a table); however, other equipment (e.g., a mat, a bench, a worktable, etc.) are also contemplated.

Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the embodiments of the present disclosure and does not pose a limitation on the scope of the present disclosure. No language in the specification should be construed as indicating any non-claimed element essential to the practice of the embodiments of the present disclosure.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A foldable gaming table comprising:

a tabletop comprising a first half and a second half, each of the first half and the second half having a top surface, a bottom surface opposite the top surface, and a sidewall extending therebetween, the first half hingedly connected to the second half;

a pair of legs, a first leg of the pair being connectable to the bottom surface of the first half and a second leg of the pair being connectable to the bottom surface of the second half of the tabletop; and a rail comprising a first half and a second half, the first half of the rail disposed on the top surface of the first half of the tabletop and the second half of the rail disposed on the top surface of the second half of the tabletop, each of the first half and the second half of the rail comprising a single unitary piece having a rail top surface, a rail bottom surface disposed against the top surface of the tabletop, a rail inner sidewall facing the tabletop, and a rail outer sidewall facing away from the tabletop, each of the first half and the second half of the rail defining at least one channel in at least one of the rail top surface and the rail outer sidewall, the at least one channel extending an entire length of, and contiguously about a first bend and a second bend of, the respective half of the rail, wherein the first half of the rail matches a shape or outline of a perimeter of the first half of the tabletop and the second half of the rail matches a shape or outline of a perimeter of the second half of the tabletop, and wherein ends of the first half and the second half of the rail flushly abut each other when the foldable gaming table is in an upright configuration such that the at least one channel of the first half of the rail is aligned with the at least one channel of the second half of the rail to define a continuous channel extending about the perimeter of the tabletop.

2. The foldable gaming table of claim 1, wherein the first and second halves of the rail are removably disposed on the top surfaces of the first and second halves of the tabletop, respectively, by one or more fasteners received in corresponding apertures in the top surfaces of the first and second halves of the tabletop.

3. The foldable gaming table of claim 1, wherein the first half of the rail is permanently affixed on the top surface of the first half of the tabletop.

4. The foldable gaming table of claim 1, wherein the second half of the rail is permanently affixed on the top surface of the second half of the tabletop.

5. The foldable gaming table of claim 1, wherein the least one channel is defined in each of the rail top surface, the rail bottom surface, the rail inner sidewall, and the rail outer sidewall.

6. The foldable gaming table of claim 1, further comprising a tray comprising a projection sized and shaped to mate with the at least one channel, the tray being slidably receivable within the continuous channel and slidable past the abutting ends of the first and second halves of the rail to a plurality of positions about the perimeter of the tabletop.

7. The foldable gaming table of claim 1, wherein the first bend and the second bend of the first half of the rail each comprise a radiused corner following the perimeter of the foldable gaming table, and the at least one channel extends contiguously through each of the radiused corners.

8. The foldable gaming table of claim 1, wherein the first bend and the second bend of the second half of the rail each comprise a radiused corner following the perimeter of the foldable gaming table, and the at least one channel extends contiguously through each of the radiused corners.

9. A foldable gaming table comprising:

a tabletop having a first half hingedly connected to a second half, the tabletop comprising:

a top surface, a bottom surface, and a sidewall extending therebetween;

a pair of legs connectable to the bottom surface of the tabletop;

a rail secured to a perimeter of the tabletop on the top surface of the tabletop, the rail comprising:

a first portion connected to a second portion, the first portion disposed about a perimeter of the first half of the tabletop and the second portion disposed about a perimeter of the second half of the tabletop, ends of the first portion and the second portion abutting one another when the foldable gaming table is in an upright configuration; and at least one groove on at least one surface of the rail, the at least one groove extending an entire longitudinal length of each of the first portion and the second portion of the rail such that the at least one groove of the first portion and the at least one groove of the second portion are aligned at the abutting ends to define a continuous groove extending about the perimeter of the tabletop; and a tray comprising a projection received within the continuous groove, the tray being slidable along the continuous groove past the abutting ends to a plurality of positions about the perimeter of the tabletop.

10. The foldable gaming table of claim 9, wherein the foldable gaming table has the upright configuration for playing games and a folded configuration for storing the foldable gaming table when not in use.

11. The foldable gaming table of claim 9, wherein the rail comprises:

a rail top surface;

a rail bottom surface secured to the tabletop;

a rail inner sidewall; and a rail outer sidewall, wherein the at least one surface of the rail in which the at least one groove is defined comprises at least one of the rail top surface, the rail bottom surface, the rail inner sidewall and the rail outer sidewall.

12. The foldable gaming table of claim 11, wherein the at least one groove is defined symmetrically in the rail inner sidewall and the rail outer sidewall.

13. The foldable gaming table of claim 11, wherein the at least one groove comprises at least one rail top surface groove.

14. The foldable gaming table of claim 11, wherein the at least one groove comprises at least one rail outer sidewall groove.

15. The foldable gaming table of claim 11, wherein the rail top surface, the rail inner sidewall and the rail outer sidewall of the first portion and of the second portion of the rail are respectively flush with one another in the upright configuration.

16. The foldable gaming table of claim 9, wherein the tray comprises a body and a plurality of cups defined by the body for holding items used in game play.

17. The foldable gaming table of claim 9, wherein the first portion of the rail comprises a single unitary piece having a first bend and a second bend following the perimeter of the foldable gaming table, and the at least one groove extends contiguously through the first bend and the second bend.

18. The foldable gaming table of claim 9, wherein the second portion of the rail comprises a single unitary piece having a first bend and a second bend following the perimeter of the foldable gaming table, and the at least one groove extends contiguously through the first bend and the second bend of the second portion.

19. The foldable gaming table of claim 9, wherein the first portion of the rail and the second portion of the rail are each reversibly fixed on the top surface of the tabletop by one or more fasteners received in corresponding apertures in the top surface of the tabletop.

20. The foldable gaming table of claim 9, wherein the rail comprises an extruded aluminum rail.

21. The foldable gaming table of claim 9, wherein each of the first portion and the second portion of the rail comprises a first rail member and a second rail member stacked on the first rail member, each of the first rail member and the second rail member defining at least one groove.

* * * * *